US007306288B2

(12) United States Patent
Hu et al.

(10) Patent No.: US 7,306,288 B2
(45) Date of Patent: Dec. 11, 2007

(54) ADJUSTABLE ARMREST ASSEMBLY

(75) Inventors: Yung-Ming Hu, Tzu-Kuan Hsiang (TW); Roger Sands, Barrington, IL (US)

(73) Assignee: KIMRO2 International Ltd., Barrington, IL (US)

( * ) Notice: Subject to any disclaimer, the term of this patent is extended or adjusted under 35 U.S.C. 154(b) by 66 days.

(21) Appl. No.: 11/306,905

(22) Filed: Jan. 16, 2006

(65) Prior Publication Data

US 2007/0085402 A1 Apr. 19, 2007

(30) Foreign Application Priority Data

Oct. 3, 2005 (TW) ..... 94217112 U

(51) Int. Cl.
*A47C 7/54* (2006.01)

(52) U.S. Cl. ..... 297/411.36; 297/411.35

(58) Field of Classification Search ..... 297/411.2, 297/411.35, 411.36
See application file for complete search history.

(56) References Cited

U.S. PATENT DOCUMENTS 1,022,632 A * 4/1912 Leigh ..... 297/411.21
3,063,722 A * 11/1962 Overbaugh ..... 473/389
3,950,027 A * 4/1976 Wilson ..... 297/411.27
5,655,814 A * 8/1997 Gibbs ..... 297/411.38
5,676,483 A * 10/1997 Koubek ..... 403/109.3
5,908,221 A * 6/1999 Neil ..... 297/411.36
6,132,001 A * 10/2000 Su ..... 297/411.36
6,398,309 B1 * 6/2002 Chen ..... 297/411.36
6,585,322 B1 * 7/2003 Lai ..... 297/411.36
6,619,746 B2 * 9/2003 Roslund et al. ..... 297/411.36
6,702,386 B2 * 3/2004 Davis et al. ..... 297/411.35
6,827,406 B2 * 12/2004 Marini ..... 297/411.36
6,843,534 B2 * 1/2005 Lee et al. ..... 297/411.35
6,974,190 B1 * 12/2005 Hung ..... 297/411.36

FOREIGN PATENT DOCUMENTS

TW 361169 6/1999
TW 557738 10/2003
TW 582242 4/2004
TW M263848 5/2005

* cited by examiner

*Primary Examiner*—Sarah B McPartlin
(74) *Attorney, Agent, or Firm*—Alan Kamrath; Kamrath & Associates PA

(57) ABSTRACT

An adjustable armrest assembly includes a support fixed to a chair seat and a sleeve slidably mounted on the support. An armrest is mounted to the sleeve to move therewith. The sleeve is slidable relative to the support to allow adjustment of a level of the armrest. The sleeve can be retained at a desired level relative to the support. An upward force is imparted to the sleeve while the sleeve is slidable relative to the support.

7 Claims, 6 Drawing Sheets

ADJUSTABLE ARMREST ASSEMBLY

BACKGROUND OF THE INVENTION

1. Field of the Invention

The present invention relates to an adjustable armrest assembly. More particularly, the present invention relates to an adjustable armrest assembly for a chair.

2. Description of the Related Art

An office chair generally comprises two armrests that can be adjusted to a desired level relative to the chair seat. A typical adjustable armrest assembly comprises a substantially L-shaped fixed support and a sleeve mounted around a vertical section of the fixed support. An armrest is mounted on top of the sleeve, and an adjusting member can be operated to allow the sleeve to move along a vertical direction to a desired level. The adjusting member is then released and the armrest is retained in the desired level. Such a structure is disclosed in Taiwan Utility Model Publication Nos. 361169 and M263848. However, it is difficult to control the magnitude of force and speed for lifting or lowering the armrest. In other words, the adjusting operation is not smooth. Further, the armrest can not be moved to the desired level when the upward force applied to the armrest is insufficient.

Taiwan Utility Model Publication No. 582242 discloses an adjustable armrest assembly using a pneumatic rod to move the armrest upward for subsequent manual adjustment to the desired level. However, the cost is high and the pneumatic rod can not be readily used with other currently available armrest devices. Namely, troublesome modification of the currently available armrest devices is required for incorporating the pneumatic rod.

SUMMARY OF THE INVENTION

An adjustable armrest assembly in accordance with the present invention comprises a support adapted to be fixed to a chair seat and a sleeve slidably mounted on the support. An armrest is adapted to be mounted to the sleeve to move therewith. The sleeve is slidable relative to the support to allow adjustment of a level of the armrest. The adjustable armrest assembly further comprises means for positioning the sleeve at a desired level relative to the support and means for biasing the sleeve upward while the sleeve is slidable relative to the support.

Preferably, the means for biasing the sleeve comprises an elastic element including a first end attached to the support and a second end attached to the sleeve.

In an embodiment of the invention, the support comprises a notch in a top thereof for engaging with the first end of the elastic element. The sleeve comprises a plug fixed to a bottom thereof, and the second end of the elastic element is fixed to the plug.

The elastic element may be a tension spring or compression spring.

Preferably, the sleeve comprises a receiving space for receiving the means for biasing the sleeve, providing a compact design.

In an embodiment of the invention, the support comprises a slot delimited by two lateral sides. A plurality of positioning grooves are defined in each lateral side. The means for positioning the sleeve comprises an operative member and two pins releasably engaged with the positioning grooves. The pins are disengaged from the positioning grooves and the sleeve is moved upward by the means for biasing the sleeve when the operative member is operated.

The armrest assembly in accordance with the present invention is simple in structure and allows smooth operation for adjusting the level of the armrest.

Further, the armrest assembly can be used with any currently available adjustable armrest devices without troublesome modification of the structures of the adjustable armrest devices.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
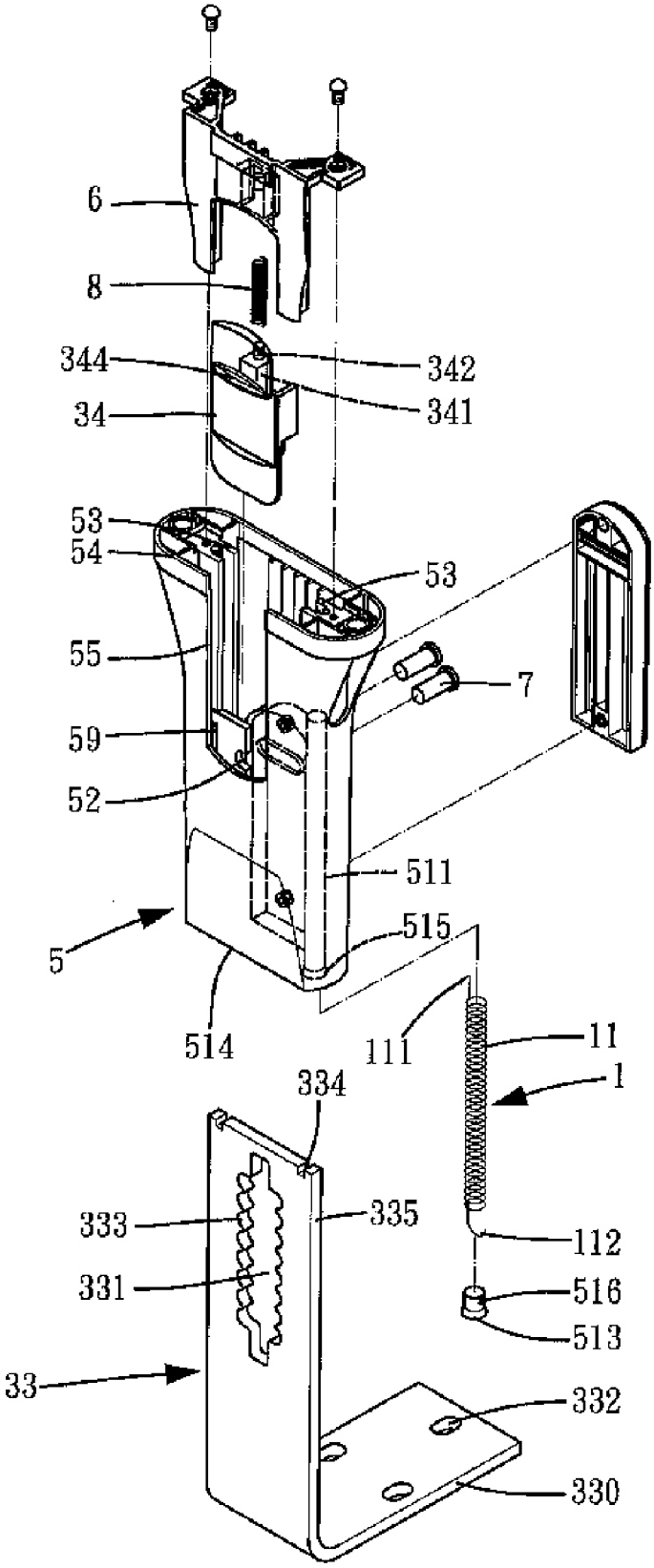
FIG. 1 is an exploded perspective view of an adjustable armrest assembly in accordance with the present invention.
Figure 2:
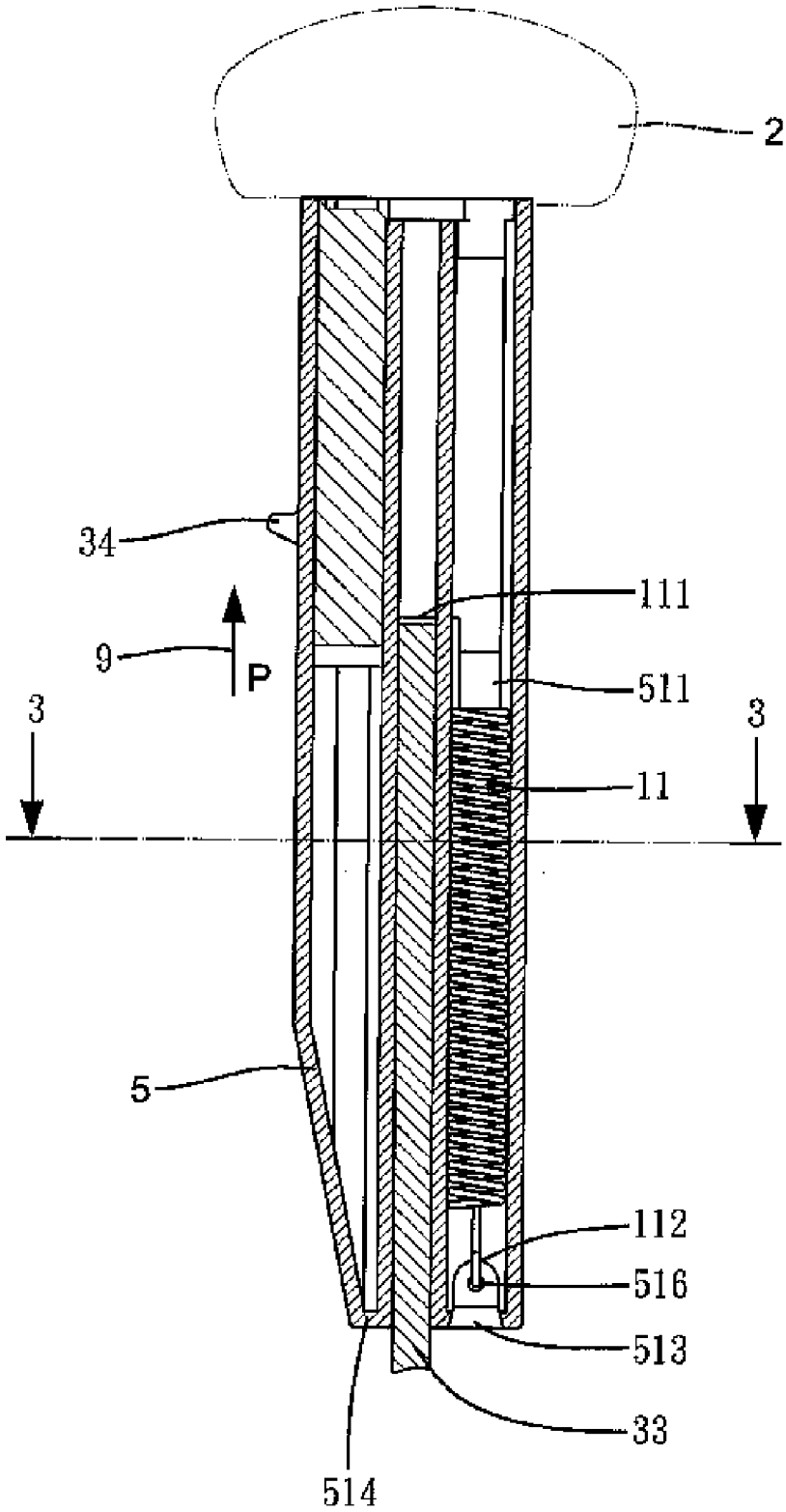
FIG. 2 is a sectional view of the adjustable armrest assembly in accordance with the present invention.
Figure 3:
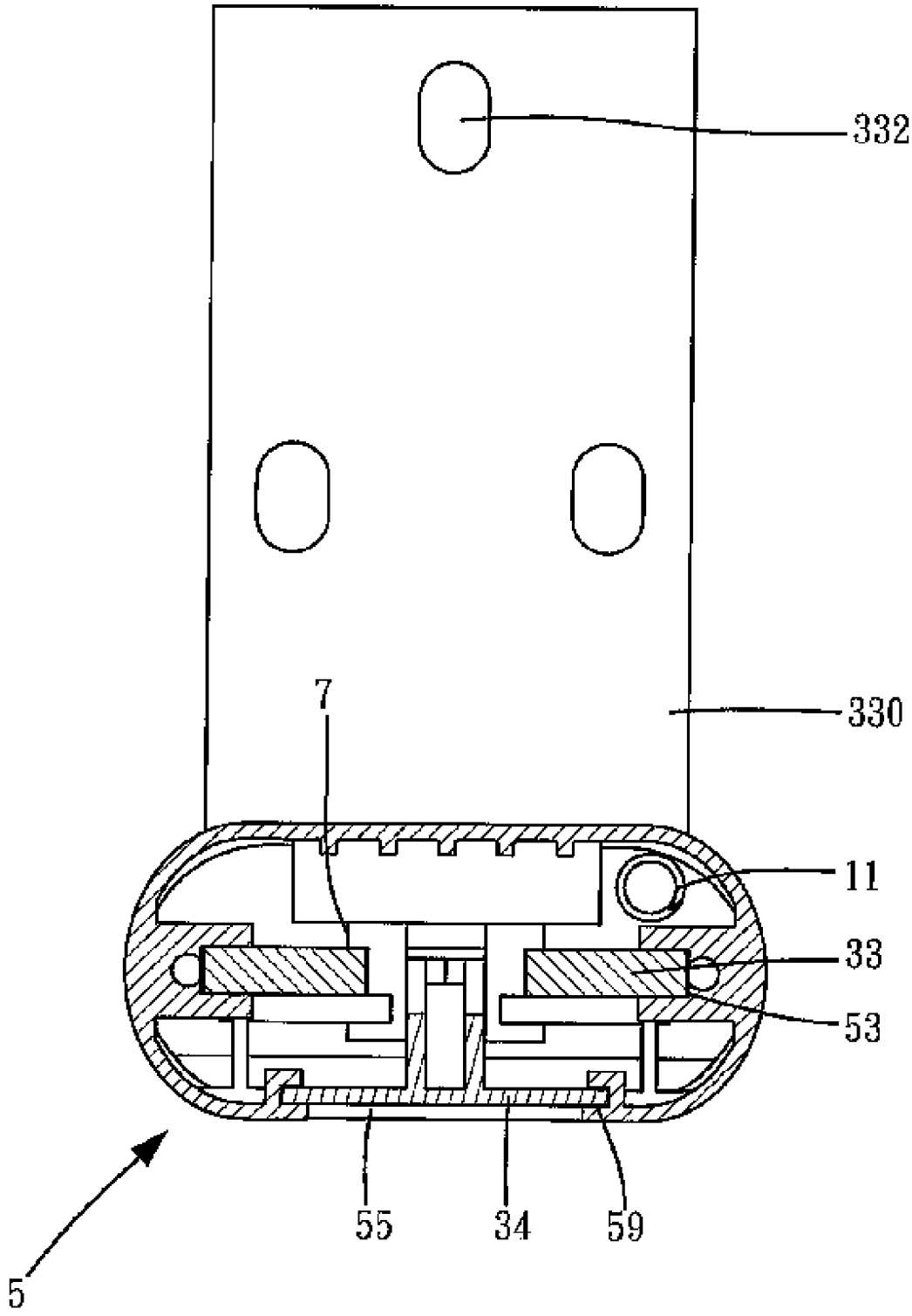
FIG. 3 is a sectional view taken along plane 3-3 in FIG. 2.

Referring to FIGS. 1 through 3, an adjustable armrest assembly in accordance with the present invention comprises a support 33 fixed to a chair seat (not shown), a sleeve 5 slidably mounted on the support 33, and means for positioning the sleeve 5 at a desired level relative to the support 33. An armrest 2 (FIG. 2) is mounted on top 54 of the sleeve 5 to move therewith. The sleeve 5 is slidable relative to the support 33 to allow adjustment of a level of the armrest 2.

The support 33 is substantially L-shaped and includes a lower, horizontal section 330 with holes 332 through which fasteners (such as screws) are extended to fix the support 33 to a chair seat (not shown) or a chair seat frame (not shown). A slot 331 is defined in a vertical section 335 of the support 33. A plurality of positioning grooves 333 are defined in each of two lateral sides delimiting the slot 331.

The sleeve 5 includes a vertical, longitudinal through-hole with two lateral guiding sections 53 for respectively and slidingly receiving two lateral sides of the vertical section 335 of the support 33. The sleeve 5 further includes two horizontally spaced holes 52. A pin 7 is extended into each hole 52 and releasably engaged in one of the positioning grooves 333 in an associated lateral side delimiting the slot 331 of the support 33. The sleeve 5 is thus retained on the support 33. Further, the sleeve 5 includes a notch 55 extending vertically downward from the top 54. A pair of guiding grooves 59 is defined in two lateral sides delimiting the notch 55.

In this example, the means for positioning the sleeve 5 at a desired level relative to the support 33 comprises an adjusting member or operative member 34 that is mounted in the notch 55, with two lateral sides of the operative member 34 slidingly received in the guiding grooves 59. A grip 344 projects outward from a front face of the operative member 34 for manual operation. Further, a protrusion 341 is provided on a rear face of the operative member 34 and includes a necked bottom 343 (see FIG. 4). The protrusion 341 includes a top 342 to which a bottom end of a spring 8 is attached.

A positioning plate 6 is mounted to the top 54 of the sleeve 5, with an upper end of the spring 8 attached to the positioning plate 6. Thus, after assembly, the spring 8 exerts a downward force to the operative member 34 such that the pins 7 are normally engaged in associated positioning grooves 333, thereby retaining the sleeve 5 on the support 33.

The above-mentioned structure has been disclosed in Taiwan Utility Model Publication No. M263848.

Of more importance, the adjustable armrest assembly in accordance with the present invention comprises means for biasing the sleeve 5 upward while the sleeve 5 is slidable relative to the support 33. The biasing means 1 in accordance with the present invention comprises at least one elastic element. In this example, the elastic element is a tension spring 11 extending along a sliding direction of the sleeve 5.

The tension spring 11 includes a first end 111 (the upper one in FIG. 2) attached to the support 33 and a second end 112 (the lower one in FIG. 2) attached to the sleeve 5. In this example, the tension spring 11 is received in a receiving space 511 in the sleeve 5, providing a compact design. Further, the first end 111 of the tension spring 11 is attached to a positioning portion 334 (such as a notch) in a top of the support 33, and the second end 112 of the tension spring 11 is attached to a plug 513 securely mounted in a hole 515 in a bottom 514 of the sleeve 5. The plug 513 includes an engaging hole 516 to which the second end 112 of the tension spring 11 is coupled. Thus, two ends of the tension spring 11 are respectively attached to the support 33 and the sleeve 5.

Figure 6:
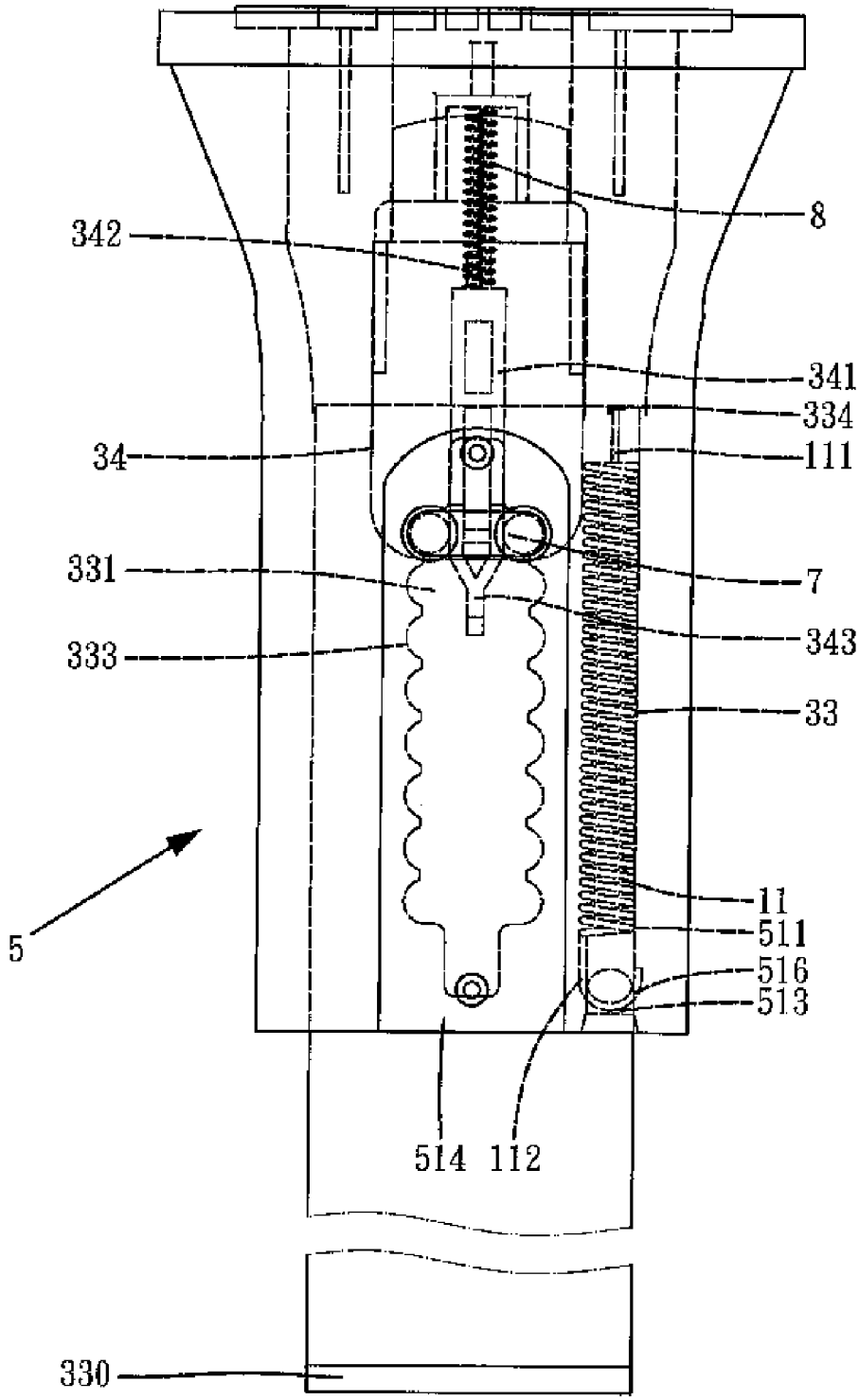
FIG. 6 is a view similar to FIG. 4, wherein the sleeve is in its highest position.

The sleeve 5 in FIG. 6 is in its highest position (i.e., the armrest 2 is in its highest position) and each pin 7 is engaged in the highest positioning groove 333 in the associated lateral side delimiting the slot 331. In this case, the tension spring 11 has not been extended yet. Preferably, the length of the tension spring 11 in its normal state is approximately the same as the distance between the top end of the support 33 and the bottom end of the sleeve 5 while the armrest 2 is in its highest position. Alternatively, the length of the tension spring 11 can be so selected that the tension spring 11 is in tension for returning purposes when the armrest 2 is in its highest position.

Figure 4:
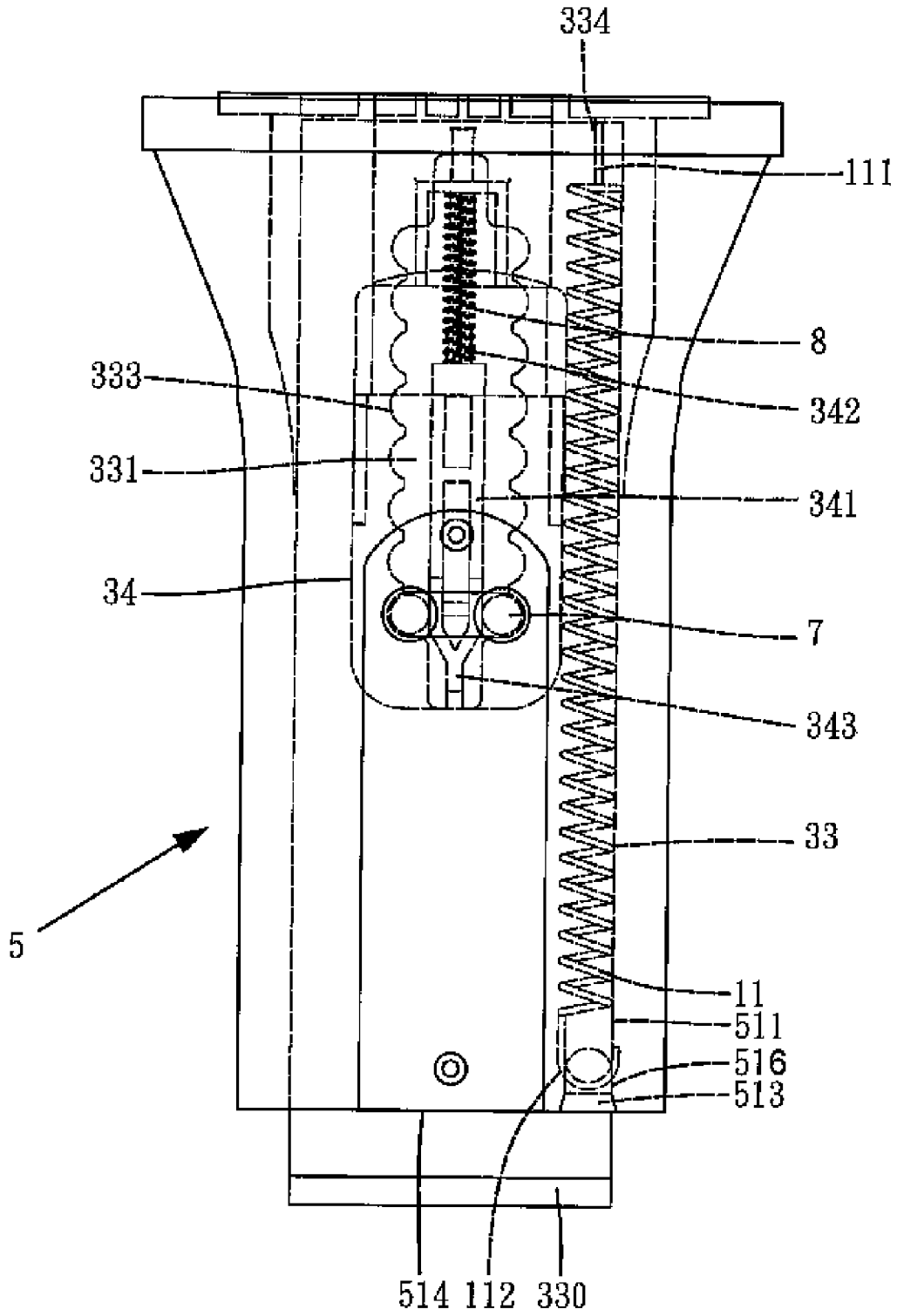
FIG. 4 is another sectional view of the adjustable armrest assembly in accordance with the present invention, wherein a sleeve of the adjustable armrest assembly is in its lowest position.

The sleeve 5 in FIG. 4 is in its lowest position (i.e., the armrest 2 is in its lowest position) and each pin 7 is engaged in the lowest positioning groove 333 in the associated lateral side delimiting the slot 331. In this case, the spring 11 is in tension (preferably maximum tension).

Figure 5:
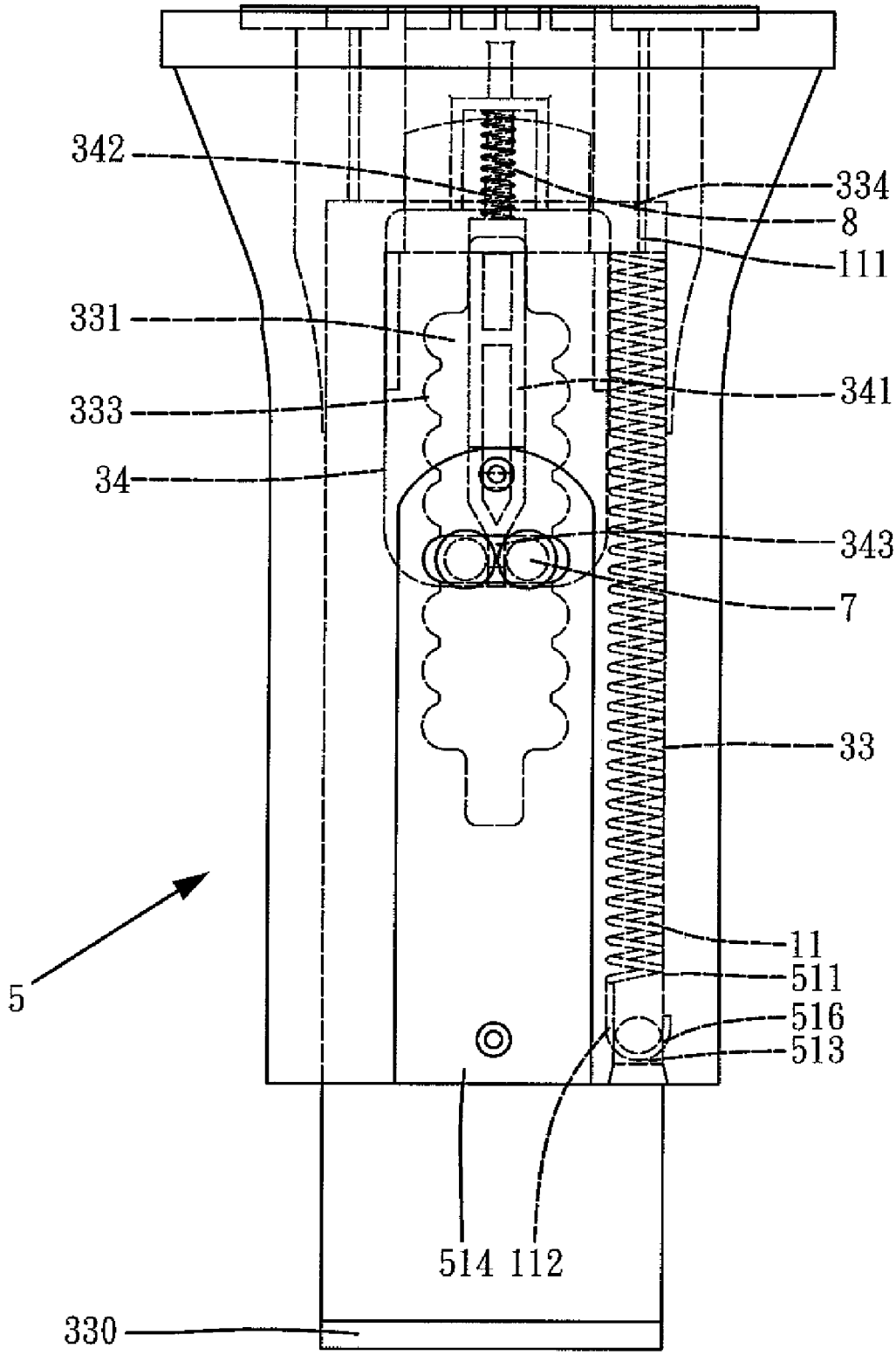
FIG. 5 is a view similar to FIG. 4, wherein the sleeve is slidable along a vertical direction.

Referring to FIG. 5, in use, the operative member 34 is pulled upward (see the arrow 9 in FIG. 2). The necked bottom 343 of the protrusion 341 is moved upward to a position between the pins 7, allowing the pins 7 to move toward each other and thus disengage from the positioning grooves 333 of the support 33. At the same time, the tension spring 11 imparts an upward force to the sleeve 5 during returning of the tension spring 11. Upward movement of the sleeve 5 carries the pins 7 upward. When the armrest reaches the desired level, the operative member 34 is released to move the necked bottom 343 of the protrusion 341 away from the pins 7. In other words, the upper portion of the protrusion 341 moves the pins 7 away from each other into the associated positioning grooves 333 of the support 33. The sleeve 5 and the armrest 2 are, thus, positioned again. In a case that the armrest 2 is still too high, the user may apply a small downward force to the armrest 2 to lower the sleeve 5 to the desired level with the operative member 34 in the pulled state until the armrest 2 reaches the desired level.

The adjusting operation of the armrest is easier and smoother (and rhythmic in a way) and the force required for adjusting is small.

The elastic element can be a compression spring that includes an upper end attached to the sleeve 5 and a lower end attached to the support 33. Thus, the compression spring is compressed when the sleeve 5 is moved downward, providing a biasing force for moving the sleeve 5 upward when adjustment of the level of the armrest is required.

The positioning portion 334 is not limited to a notch, and it can be provided on a location other than the top of the support 33. Further, the lower end of the tension spring 11 can be attached to a location other than the bottom of the sleeve 5, and the plug 513 can be replaced with other arrangement.

The biasing means in accordance with the present invention can be used with any currently available adjustable armrest devices without troublesome modification of the structures of the adjustable armrest devices. The biasing means in accordance with the present invention allows easy, smooth operation for adjusting the level of the armrest at a low cost, for the adjustable armrest assembly using the biasing means for biasing the sleeve upward for subsequent adjustment is simple in structure.

Although a specific embodiment has been illustrated and described, numerous modifications and variations are still possible without departing from the essence of the invention. The scope of the invention is limited by the accompanying claims.

What is claimed is:

1. An adjustable armrest assembly comprising:

a support adapted to be fixed to a chair seat;

a sleeve slidably mounted around the support and slidable in a slide direction, with the sleeve including a vertical hole slidably receiving the support, with the sleeve further including a receiving space extending in the slide direction and separate and spaced from the vertical hole, with the sleeve being slidable relative to the support to allow adjustment of a level of the sleeve between a highest position and a lowest position;

a sleeve positioning structure mounted on the sleeve releasably positioning the sleeve at a desired level relative to the support and operable to allow sliding movement of the sleeve relative to the support for adjusting the level of the sleeve; and an elastic element mounted in the receiving space of the sleeve, with the elastic element including a first end attached to the support and a second end attached to the sleeve, with the elastic element being in greater tension while the sleeve is not in the highest position than while the sleeve is in the highest position with the elastic element biasing the sleeve upward relative to the support.

2. The adjustable armrest assembly as claimed in claim 1 wherein the support comprises a notch in a top thereof for engaging with the first end of the elastic element.

3. The adjustable armrest assembly as claimed in claim 1 wherein the sleeve comprises a plug fixed to a bottom thereof, and wherein the second end of the elastic element is fixed to the plug.

4. The adjustable armrest assembly as claimed in claim 1 wherein the elastic element is a tension spring.

5. The adjustable armrest assembly as claimed in claim 4, with the first end of the tension spring being coupled to a top of the support, with the second end of the tension spring being attached to a bottom of the sleeve, and with the tension spring including a length approximately the same as a distance between the top of the support and the bottom of the sleeve when the sleeve is in the highest position.

6. The adjustable armrest assembly as claimed in claim 1 wherein the support is a single flat monolithic piece and comprises a slot cut out from the support and delimited by two lateral sides, with a plurality of vertically spaced positioning grooves being defined in each said lateral side, with said sleeve positioning structure comprising an operative member having a protrusion and a necked bottom and two pins releasably engaged with the positioning grooves, with the protrusion engaging the two pins in the positioning grooves in an engaged position vreventing movement of the pins and the operative member along the slot, with the necked bottom contacting the two pins in a disengaged position and allowing free movement of the ins and the operative member alon the slot, and with the two pins being disengaged from the positioning grooves and the sleeve being moved upward by the elastic element when the operative member is operated.

7. The adjustable armrest assembly as claimed in claim 6, with the elastic element being not extended and each said pin being engaged in a highest one of the plurality of grooves of one of the lateral sides delimiting the slot when the sleeve is in the highest position.

* * * * *